United States Patent [19]

Zentman

[11] 3,968,524

[45] July 13, 1976

[54] BATHTUB SAFETY GRIPPING RAIL

[76] Inventor: Leo Zentman, c/o Orthopedic Splints, Inc., 147 Albany Ave., Lindenhurst, N.Y. 11757

[22] Filed: Nov. 13, 1975

[21] Appl. No.: 631,455

[52] U.S. Cl ..... 4/185 H

[51] Int. Cl.[2] ..... A47K 3/12

[58] Field of Search ..... 4/185 H, 185 R, 172.18

[56] References Cited

UNITED STATES PATENTS

| | | | |
|---|---|---|---|
| 2,045,815 | 6/1936 | Wiesjahn | 4/185 H |
| 2,931,051 | 4/1960 | Sparling | 4/185 H |
| 2,940,085 | 6/1960 | Hussey | 4/185 H |

FOREIGN PATENTS OR APPLICATIONS

| | | |
|---|---|---|
| 858,754 | 12/1970 | Canada. |

*Primary Examiner*—Henry K. Artis
*Attorney, Agent, or Firm*—Bauer, Amer & King

[57] ABSTRACT

A safety gripping rail attached to a bathtub wall to assist in climbing into and out of the bathtub, in which the attaching clamps include slidably interconnected L-shaped members which close in engagement about the bathtub wall and are held engaged thereagainst by a threaded bolt associated with one L-shaped member engaged in threads associated with the other L-shaped member. Specifically, the threads are an integral structural feature of said other L-shaped member, thereby obviating a separate nut or similar component to cooperate with the bolt to complete the clamping action.

5 Claims, 11 Drawing Figures

BATHTUB SAFETY GRIPPING RAIL

The present invention relates generally to improvements for a bathtub safety rail, and more particularly to an improved clamp for fixing the rail in position on the bathtub wall.

To neutralize slippery conditions, assist the elderly, and for other such reasons, it is advisable to attach a gripping rail to a bathtub wall so that the user can steady himself while climbing into and out of the bathtub. Known gripping or safety rails use clamps to complete their attachment to the bathtub wall. Characterizing each clamp is a bolt which threadably engages a nut, or its equivalent, and thus enables the clamp to firmly grip the bathtub wall. While this conventional use of a bolt and a cooperating nut is effective, it is not an optimum solution. The nut, being a separate comparatively small component, is easy to misplace, and further is difficult to hold against rotation during the establishment of meshing engagement with it by the bolt.

Broadly, it is an object of the present invention to provide an improved bathtub safety rail, or more particularly, an improved clamp for same, which overcomes the foregoing and other shortcomings of the prior art. Specifically, the improved clamp is a two-piece or unit construction, in which the bolt and threads with which it engages are integrally embodied in said units, thereby obviating any need for a nut or an equivalent, separate component.

An improved bathtub safety gripping rail demonstrating objects and advantages of the present invention includes as the gripping rail a conventional substantially U-shaped body adapted to be oriented in alignment with the bathtub wall with opposite ends thereof in fixed position in relation to said bathtub wall. Provided as a clamp for achieving the fixed position of each said rail body opposite end is a cooperating pair of L-shaped clamping members slidably interconnected for closing movement when positioned transversely of said bathtub wall against opposite surfaces of said bathtub wall. An elongated connector having threads therealong, i.e. a bolt, is operatively associated with one said L-shaped clamping member, and threads for threadably engaging said elongated connector are operatively arranged on the other L-shaped clamping member. More particularly, said other L-shaped clamping member has a groove of semi-circular configuration in cross section to receive the connector, and said threads are formed in the wall bounding said groove; thus the threads are of a corresponding semi-circular configuration. In use, the grooves are aligned to guide the bolt into threadable engagement with the threads, and this is effective to urge the one L-shaped clamping member through closing movement in relation to the other L-shaped clamping member, to thereby achieve clamping engagement of the clamps to the bathtub wall.

The above brief description, as well as further objects features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 8 is the preferred arrangement.

Figure 1:
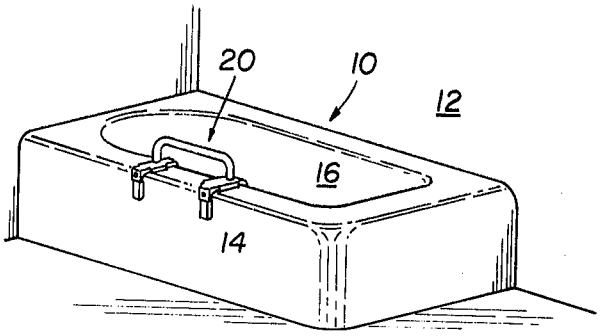
FIG. 1 is a perspective view of a bathtub with the safety gripping rail hereof installed thereon.

Reference is now made to the drawings, and in particular to FIG. 1, illustrating a bathtub structure 10 which typically is located with one side adjacent a wall 12, and which has its other side or wall 14, which is spaced from the wall 12, presenting a bathtub structure which the user must climb over when getting into and out of the tub 16. It is generally understood, because bathing in the bathtub 10 involves the use of water and contributes to slippery conditions, that it is useful to have a rail or similar structure, generally designated 20, appropriately attached to the bathtub wall 14, which can advantageously be gripped by the user in order to steady himself, when climbing over the wall 14. The use of a safety gripping rail 20, as just generally described, is particularly advantageous for the elderly.

Figure 2:
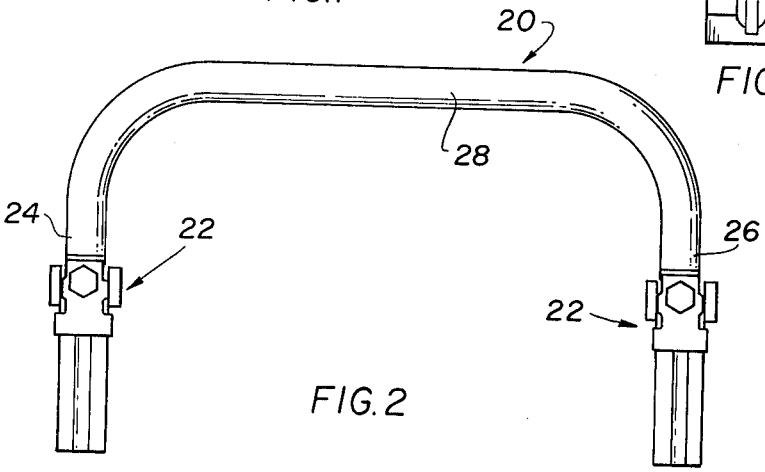
FIG. 2 is a front elevational view of the safety gripping rail showing further structural features thereof.

Although bathtub safety gripping rails 20 are generally known, none have a pair of clamp structures, each designated 22 in FIG. 2, which will now be described in detail, which so effectively support opposite ends 24 and 26 of the cylindrical rail body 28 in their selected fixed locations along the bathtub wall 14. Since each of these clamp members 22 are identical as to their construction and mode of use, the description of one, which now follows, will suffice for both.

Figure 5:
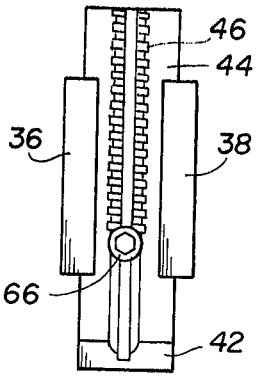
FIG. 5 is a bottom view taken in the direction of the arrows along line 5–5 of FIG. 4.
Figure 6:
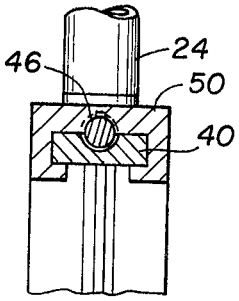
FIG. 6 is a sectional view taken along line 6–6 of FIG. 3 showing further structural details of the clamp.
Figure 3:
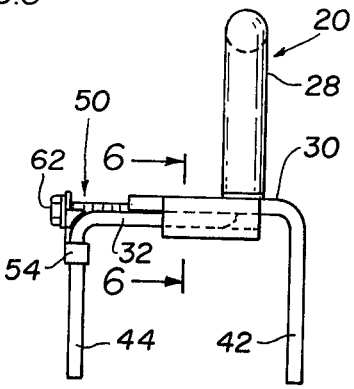
FIG. 3 is a side elevational view projected from FIG. 2.
Figure 4:
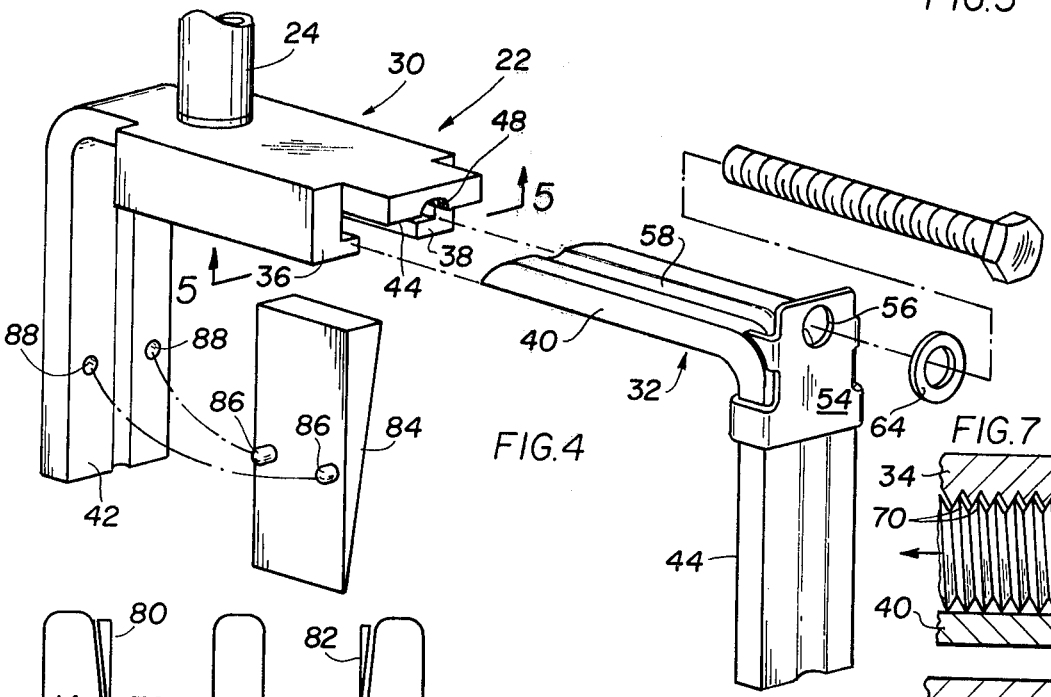
FIG. 4 is a perspective view of the clamp holding one end of the safety gripping rail, the same being shown in disassembled condition.

Specifically, and as is perhaps best illustrated in FIG. 4 in conjunction with FIGS. 3, 5 and 6, each clamp 22 is a two-piece structure comprised of a first clamp member 30 and a second clamp member 32. Each of the clamp members 30, 32 is essentially L-shaped, and one leg of each slidably telescopes or interconnects with the other. To this end, the leg 34, which leg is horizontally oriented in use, has depending L-shaped walls 36 and 38 along opposite edges which cooperate to form a track therebetween which slidably receives the horizontally oriented leg 40 of the other clamp member 32. It is the sliding or telescoping movement of the two clamps 30 and 32 with respect to each other that provides closing movement of the other depending legs 42 and 44 against opposite sides of the bathtub wall 14 incident to achieving clamping engagement of each clamp 22 to the bathtub wall 14. This closing movement, of course, requires the positioning of each clamp member 22 transversely of the bathtub wall 14, as is clearly illustrated in FIG. 1.

By reference to FIGS. 3, 5 and 6 in conjunction with FIG. 4, it will be better understood how the legs 42 and 44, once closed upon the bathtub wall 14, are held in firm gripping engagement with the bathtub wall and, in turn, thus firmly hold each end 24 and 26 of the safety gripping rail 20 in place. Specifically, each clamping member 30, and more particularly the leg 34 thereof, is appropriately provided on its under-surface 44, in a central location as best illustrated in FIG. 5, with threads 46. More particularly, the body of the member 30 is extruded or cast with a groove on its under-surface 44, said groove being oriented lengthwise of leg 34 and having a semi-circular shape or configuration, designated 48 in FIG. 4. It is on the surface that bounds the groove 48 just described, that the threads 46 are applied. Thus each thread 46 like groove 48, circumscribes only 180 degrees, rather than the usual 360 degrees.

Cooperating with the partially threaded groove 48 of clamping member 30 is a bolt or connector 50 having a cylindrical body with threads 52 appropriately machined therealong. Mounted on member 32 at the intersection of its legs 40 and 44 is a holder 54 having a cylindrical opening 56 through which, in practice, connector 50 is projected. A partial unthreaded groove 58 functions as a seat for the threaded body 52 of connector 50. It will be understood that the partial grooves 58 and 48 are in alignment with each other so that connector 52 seated in groove 58 will be properly positioned for achieving threadable engagement between the threads 52 on the connector 50 with the threads 46 of the groove 48. This occurs, of course, when the clamping members 32 and 34 are slidably interconnected with each other. In this regard, the extent to which the depending or vertically oriented legs 42 and 44 of each clamp 22 are permitted to close upon each other, and thus about the bathtub wall 14, will be a function of the extent to which there is threadable or meshing engagement between the connector 50 and the threads 46 of groove 48. To facilitate threaded adjustment of connector 50, this member is provided with a bolt head 62, as illustrated. Also as shown, advantageous use is made of washer 64 during the bolting together of the two clamping members 30 and 32 about the bathtub wall 14.

Although many different techniques may be used to connect the opposite ends of the rail body 28 to each cooperating clamp 22, the preferred technique, as illustrated in FIG. 5, consists of physically attaching each end, as by a bolt 66, to leg 34 of each clamping member 30.

Figure 7:
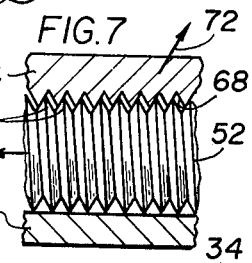
FIGS. 7 and 8 are enlarged views illustrating the manner in which threadable engagement between members of the clamp contribute to its clamping action. Of these two figures.
Figure 8:
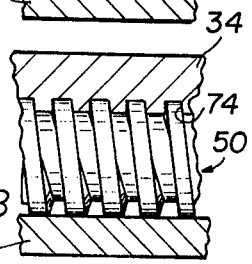

Reference is now made to FIGS. 7 and 8 which, in comparison, illustrate the preferred manner of achieving clamping engagement of each clamp 22 to the bathtub wall 14. Specifically, while it is contemplated that any shape thread may be used for the groove 48 and the connector 50, the so-called acme thread shape of FIG. 8 is preferred to the conventional shape illustrated in FIG. 7. The reason is that the conventional shape includes V-shaped individual threads 68 and correspondingly angularly oriented thread surfaces 70 along the connector body 52. In the meshing engagement of these shapes there is a tendency to cause a wedging or camming apart, as in the direction 72, of top leg 34 from bottom leg 40. The foregoing, however, is eliminated by the acme thread shape illustrated in FIG. 8 in which the individual threads provided along the undersurface of leg 34 are defined by walls 74 which are generally perpendicularly oriented with respect to the longitudinal axis of the connector 50.

Figure 9A:
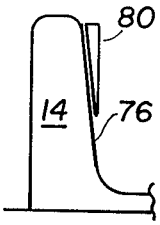
FIGS. 9*a*, 9*b* and 9*c* illustrate typical profiles of bathtub walls to which the within safety gripping rail, in practice, is required to be attached.
Figure 9B:
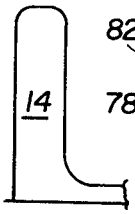
Figure 9C:
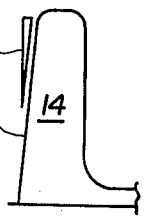

Reference is now made to remaining FIG. 9*a*, 9*b* and 9*c*. These figures show typical profiles or shapes of bathtub walls 14. Specifically, in FIG. 9*a* the inside surface 76 is oriented at an angle of 8 degrees to the essentially vertically oriented outside wall surface. This is in contrast to the bathtub wall shape 14 of FIG. 9*c* in which it is the outside wall surface 78 which is angled 5 degrees towards the essentially vertically oriented inside surface. In contrast to both of the foregoing, shape 14 of FIG. 9*b* is defined by parallel surfaces which are each essentially vertically oriented. As a consequence, the bathtub wall 14 of FIG. 9*b* requires no adjustments, whereas preparatory to use of the clamps 22 hereof, shape 14 of FIG. 9*a* requires a wedge 80 in the location illustrated to compensate for the angular orientation of surface 76. That is, use of wedge 80 essentially converts surface 76 to a generally vertically oriented support surface for the clamps 22. In similar fashion, wedge 82 performs the same function for shape 14 of FIG. 9*c*.

In lieu of using the wedges 80 and 82 as just described, or in conjunction therewith, use can also be made of a wedge 84, as illustrated in FIG. 4, which is attached to the leg of the clamping member which is adapted to contact an angularly oriented surface of a bathtub wall. In the circumstance illustrated in FIG. 4, wedge 84 is attached to the depending leg 42 of clamp 30. To this end, wedge 84 has horizontally oriented projections 86 which are sized to provide a friction fit in cooperating openings 88 in leg 42.

From the foregoing it should be readily appreciated that there has been described an improved safety gripping rail for a bathtub wall, the improvement being comprised, in large measure, of the greatly simplified clamp 22 for each of the opposite ends of the rail body 28. In part, the noteworthy simplicity of the clamps resides in the integral embodiment of the threads 46 as one of the two cooperating clamping members which close upon and engage the bathtub wall 14 therebetween. This is in contrast to known clamps which require the use of a nut or a similar component to achieve threaded engagement with the bolt or connector 50. Among other disadvantages, the use of a nut requires use of structure holding the same against rotation while threaded or meshing engagement is achieved with the bolt or connector 50.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In combination, a safety gripping rail for attachment to a bathtub wall of the type including a substantially U-shaped body adapted to be oriented in alignment with said bathtub wall with opposite ends thereof in fixed position in relation to said bathtub wall, and a clamp for achieving said fixed position of each said rail body opposite end, each said clamp comprising a cooperating pair of L-shaped clamping members slidably interconnected for closing movement when positioned transversely of said bathtub wall against opposite surfaces of said bathtub wall, an elongated connector having threads therealong operatively associated with one said L-shaped clamping member, and threads for threadably engaging said elongated connector operatively arranged on said other L-shaped clamping member, said other L-shaped clamping member having a groove of semi-circular configuration in cross section to receive said connector and said threads being formed in the wall bounding said groove and of a corresponding semi-circular configuration, whereby threadable adjustment of said connector within said threads is effective to urge the one said L-shaped clamping member through closing movement in relation to said other L-shaped clamping member to achieve clamping engagement of said clamps to said bathtub wall.

2. A bathtub safety gripping rail as defined in claim 1 wherein said clamping member having said threads overlies said other clamping member in said slidably interconnected positions thereof, and said bottom clamping member has an unthreaded semi-circular groove aligned with said threaded groove for guiding said connector into said threaded groove.

3. A bathtub safety gripping rail as defined in claim 2 wherein said upper clamping member has depending L-shaped peripheral walls for slidably engaging therebetween said lower clamping member.

4. A bathtub safety gripping rail as defined in claim 3 wherein each said thread of said clamping member is defined by walls oriented perpendicularly of said connector and said threads on said connector are similarly perpendicularly oriented, whereby wedging apart of said clamping members in response to threaded adjustment of said connector within said threads is minimized.

5. A bathtub safety gripping rail as defined in claim 4 wherein wedge-shaped members are attached to the depending legs of said clamping members which engage said bathtub wall therebetween, said wedge-shaped members being sized and proportioned to compensate for any angular orientation in the surfaces defining said bathtub wall.

* * * * *